US006024157A

United States Patent [19]

Donahue et al.

[11] Patent Number: 6,024,157

[45] **Date of Patent: *Feb. 15, 2000**

[54] METHOD OF CASTING HYPEREUTECTIC ALUMINUM-SILICON ALLOYS USING AN EVAPORABLE FOAM PATTERN AND PRESSURE

[75] Inventors: Raymond J. Donahue, Fond du Lac; Terrance M. Cleary, Allenton, both of Wis.

[73] Assignee: Brunswick Corporation, Lake Forest, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/975,693

[22] Filed: Nov. 21, 1997

[51] Int. Cl.[7] ..... B22C 9/04; B22D 27/13

[52] U.S. Cl. ..... 164/34; 164/120

[58] Field of Search ..... 164/34, 35, 120

[56] References Cited

U.S. PATENT DOCUMENTS 4,603,665 8/1986 Hesterberg et al. .
4,966,220 10/1990 Hesterberg et al. .
4,969,428 11/1990 Donahue et al. .
5,014,764 5/1991 Garat .
5,234,514 8/1993 Donahue et al. .
5,290,373 3/1994 Donahue et al. .
5,355,930 10/1994 Donahue et al. .
5,524,696 6/1996 Osborne et al. .

*Primary Examiner*—Kuang Y. Lin
*Attorney, Agent, or Firm*—Andrus, Sceales, Starke & Sawall

[57] ABSTRACT

A method of casting hypereutectic aluminum-silicon alloys in an evaporable foam casting process with the application of pressure during the solidification of the alloy. A pattern is formed from a polymeric material having a configuration of an article to be cast. The pattern is supported in an outer mold and unbounded sand surrounds the pattern and fills the cavities within the pattern. The pattern is contacted with a molten hypereutectic aluminum-silicon alloy containing 16% to 30% silicon and having less than 0.8% copper. The molten alloy decomposes the foam pattern with the vapors of decomposition being entrapped within the interstices of the sand. While the alloy is in the molten state, gas pressure is applied to the alloy in the magnitude of 5 to 12 atmospheres to produce a cast alloy having less than 0.03% porosity and a high cycle fatigue strength greater than 13 KSI.

5 Claims, No Drawings

METHOD OF CASTING HYPEREUTECTIC ALUMINUM-SILICON ALLOYS USING AN EVAPORABLE FOAM PATTERN AND PRESSURE

BACKGROUND OF THE INVENTION

Aluminum-silicon alloys containing less than about 11.6% by weight of silicon are referred to as hypoeutectic alloys and have seen extensive use in the past. The unmodified alloys have a microstructure consisting of primary aluminum dendrites with a eutectic composed of acicular silicon in an aluminum matrix. However, the hypoeutectic aluminum-silicon alloys lack wear resistance.

On the other hand, hypereutectic aluminum-silicon alloys, those containing more than about 11.6% silicon, contain primary silicon crystals which are precipitated as the alloy is cooled between the liquidus temperature and the eutectic temperature. Due to the high hardness of the precipitated primary silicon crystals, these alloys have good wear resistant properties. The hypereutectic aluminum-silicon alloys can thus be used in linerless aluminum engine blocks. This application for hypereutectic aluminum-silicon alloys has several advantages. First, the cast iron cylinder liner can be eliminated because the primary silicon particles in the microstructure of the hypereutectic alloys can impart a wear resistance greater than that of cast iron if the volume fraction of the primary silicon particles is high enough. The use of a hypereutectic aluminum-silicon engine block reduces the weight of the engine as compared to the use of a cast iron block or an aluminum block with cast iron liners. There is also a significant manufacturing cost savings when not using separately cast liners.

Because of the higher silicon content, the hypereutectic aluminum-silicon alloys have a higher modulus of elasticity and a lower coefficient of thermal expansion than hypoeutectic aluminum-silicon alloys. These physical properties are particularly advantageous for two-stroke cycle engines that inherently, by physical design constraints, have to expel a hot exhaust through a port in the cylinder wall which creates an "impossible to cool" hot spot and leads to bore distortion. The higher modulus of elasticity and the lower coefficient of thermal expansion of hypereutectic aluminum-silicon alloys are thus the material properties ideally suited to mitigate the bore distortion problem that the two-stroke cycle engine inherently has by design.

A linerless hypereutectic aluminum-silicon engine block design also allows better conduction of heat from the combustion chamber. In an aluminum block with cast iron liners, heat transfer is slowed because the heat must pass through a cast iron liner wall and then through an air gap behind the liner before it gets into the high conductivity aluminum-silicon alloy block material. Thus, piston temperatures are lower in a linerless hypereutectic aluminum-silicon alloy engine block than in a cast iron linered two-stroke cycle engine block. This also means that engine durability and life would be superior for the linerless hypereutectic aluminum-silicon alloy engine block design. Finally, it should be appreciated that hypereutectic aluminum-silicon alloys have true endurance limits in fatigue and hypoeutectic aluminum-silicon alloys do not. In spite of the above, the advantages of hypereutectic aluminum-silicon alloy engine blocks are not fully realized in practice because these alloys are difficult to cast porosity-free. In fact the only production examples of hypereutectic aluminum-silicon alloy engine blocks use a metal mold casting technique like die casting. Even the metal mold quality level does not eliminate all porosity. This is because even a small amount of porosity in the bores of a four-stroke cycle engine increase the oil consumption. In essence, the porosity in the bore surface defeats the purpose of the piston ring and allows oil to be pushed into the porosity area as the ring passes over the porosity area and to exit and burn in the new environment on the other side of the ring.

It is recognized that a slower cooling rate casting process using sand molds would produce more porosity in an aluminum-silicon alloy than a faster cooling rate process using metal molds, and would be less acceptable as a manufacturing process to produce linerless hypereutectic aluminum-silicon engine blocks. Because of this, one would conclude that the commercial copper-containing, hypereutectic aluminum-silicon alloys, such as aluminum alloy 390, are not candidates for use in sand casting processes.

It is also recognized that the tensile properties of aluminum-silicon alloys decrease as the cooling rate of the casting process decreases. Thus, the faster the cooling rate, the better the mechanical properties. This is due to the difficulty in obtaining a fine, modified grain structure at very slow cooling rates, and the increased tendency for castings to be less sound if they freeze slowly. For example, a 356 hypoeutectic-aluminum-silicon alloy when sand cast and subjected to a T6 heat treatment has an ultimate tensile strength of 33 ksi, a yield strength of 24 ksi, and an elongation in 2 inches of 3.5%. On the other hand, the same alloy when cast using a permanent metal mold and subjected to the same heat treatment has an ultimate tensile strength of 38 ksi, a yield strength of 27 ksi and an elongation of 5% in a two inch gauge length. This increase in mechanical properties of the cast alloy is due to the faster cooling rate achieved through use of a permanent metal mold.

It is also recognized that the application of pressure to the molten aluminum-silicon alloy during casting of articles made by metal mold casting processes can increase the mechanical properties of the cast alloy. The improvement in mechanical properties is due to the decreased porosity achieved by virtue of the application of pressure during solidification of the alloy.

Evaporable foam casting, also known as lost foam casting, is a known technique in which a pattern is formed of an evaporable polymeric material, such as polystyrene, having a configuration substantially identical to the part to be cast. The pattern is normally coated with a ceramic wash coat which prevents metal-sand reaction and facilitates cleaning of the cast metal part. The pattern containing the wash coat is supported in the mold and surrounded by an unbonded particulate material, such as sand. When the molten metal contacts the pattern, the foam material in various fractions melts, vaporizes and decomposes with the liquid and vapor products of degradation passing into the interstices of the sand, while the molten metal replaces the void created by vaporization of the foam material, to thereby form a cast article identical in shape to the pattern.

When casting hypoeutectic aluminum-silicon alloys using the evaporable foam process, the control of porosity is critical because fatigue properties and ductility are dependent on the porosity level. It is recognized that grain refinement has an effect on the microstructure of the alloy and, therefore, affects the porosity. Grain refinement in aluminum-silicon alloys is typically accomplished by the addition of a titanium compound which causes a decrease in the size of the primary aluminum grains. The best combination of conditions to promote extensive nucleation with titanium additions, and hence a reduced grain size, is the presence of a large number of nuclei coupled with a slow rate of freezing to provide the required time span for the nuclei to react.

It is also known that strontium additions can cause a refinement of the eutectic silicon in aluminum-silicon alloys. The strontium addition increases the strength and ductility of the alloy, but on the downside, can cause a "pick-up" of hydrogen that increases porosity.

It is virtually impossible to avoid at least some hydrogen "pick-up" by molten aluminum-silicon alloys, because of contact of the alloy with air. Air contains moisture and thermodynamics dictate that there will be a reaction between the molten aluminum alloy and water vapor that will yield a metal oxide and release hydrogen. In addition, there are numerous other source of moisture, such as charging scrap, the furnace lining, the ladle lining, the foam pattern, and the like. The end result is that it is virtually impossible to avoid at least some hydrogen "pick-up" and the hydrogen content has a major role in producing porous castings.

The porosity level is critical in cast marine engine blocks with cast iron liners designed for use in high performance applications. Engine blocks of this type must meet higher mechanical property requirements. Fatigue failures can occur at the sites of porosity. Because of this, engine blocks of this type should have less than 0.75% porosity and should have an elongation in 2 inches of greater than 3%. Hypereutectic aluminum-silicon alloys are more difficult to cast porosity free than hypoeutectic aluminum-silicon alloys. Therefore, it would be expected that hypereutectic aluminum-silicon alloys when cast in a lost foam casting process would yield castings with greater than 0.75% porosity. In fact, the porosity figure for hypereutectic aluminum-silicon alloys when cast in a lost foam casting process is generally double or triple the 0.75% porosity figure for a sand cast hypoeutectic aluminum-silicon 356 alloy that exhibits an elongation of approximately 3% in a two inch gauge. This porosity problem is the reason hypereutectic aluminum-silicon alloys have not been used in the lost foam casting processes to make linerless aluminum alloy engine blocks. Clearly, the porosity requirement is more stringent for a four stroke linerless engine block which has a very low oil consumption requirement, than for a block containing cast iron liners, in which case the porosity requirement is faced by the manufacturer of the liners.

U.S. Pat. No. 5,014,764 is directed to a method of lost foam casting in which gas pressure is applied to the mold and to the molten metal, thus improving the density and mechanical properties of the cast article. The casting method of that patent is directed specifically to the casting of hypoeutectic aluminum-silicon alloys containing less than 11.6% aluminum, for the purpose of causing a hot deformation of the already solidified metal network under pressures higher than 1.5 MPa (i.e. 13 atmospheres) and, in particular, higher than 5 MPa (approximately 50 atmospheres) up to 10 MPa (approximately 100 atmospheres). French patent application No. 2606688 described a different phenomena that is operative in the 0.5 MPa to 1.5 MPa range, and indicates pressure serves mainly to accelerate the flow of molten metal between the dendrites of the solidifying metal and the effect stops when the solid network has reached a certain stage of development. The aluminum-silicon alloy that is described in the French this application is the hypoeutectic aluminum-silicon alloy 356. The teachings of the French patent application have proven to be effective for aluminum-silicon 356 with 10 atmospheres of pressure but subsequent work with other hypoeutectic aluminum-silicon alloys, such as alloy 319 and alloy 380, indicate that 10 atmospheres of pressure with these alloys does not lower porosity levels to the low values obtainable for alloy 356.

SUMMARY OF THE INVENTION

The invention relates to a method of evaporable foam casting of hypereutectic aluminum-silicon alloys which results in decreased porosity and improved fatigue properties in the cast alloy.

A pattern formed of a foam polymeric material, such as polystyrene, and having a configuration corresponding to an article to be cast, is supported in an outer mold. An unbonded particulate material, such as sand, surround the pattern and fills the cavities within the pattern.

The pattern is contacted with a molten hypereutectic aluminum-silicon alloy containing 16% to 30% silicon and having less than 0.8% copper, and preferably less than 0.6% copper. The molten alloy will melt, vaporize, and decompose in various fractions the polymeric pattern, and the resulting products of decomposition pass through the porous ceramic coating on the pattern and into the interstices of the sand. The molten metal will thus occupy the void created by vaporization of the pattern to produce a cast metal article substantially identical in configuration to the pattern.

While the alloy is still in a molten state, pressure is applied to the alloy. In a preferred form of the invention, the mold along with the pattern is placed in an outer vessel and after the molten alloy has been poured, the vessel is sealed and gas pressure at a value of 5 atmospheres to 12 atmospheres is applied to the interior of the vessel. The pressure, which is gradually or progressively increased during solidification of the alloy, decreases porosity in the casting and substantially improves the mechanical properties of the cast alloy. Solidification of hypereutectic aluminum-silicon alloys begin with the precipitation of primary silicon at the liquidus. The second phase that precipitates is a small volume fraction of the dendritic aluminum phase, rather than the eutectic phases as expected from the equilibrium phase diagram. The dendritic aluminum phase nucleates on the primary silicon particles and grow while the primary silicon particles continue to grow. The aluminum dendrites become coherent, i.e. they impinge on adjacent dendrites, just prior to the eutectic reaction. The eutectic reaction takes place over a temperature range, rather than at a constant temperature as it would for a binary system, because commercial hypereutectic aluminum-silicon alloys contain significant amounts of both copper and magnesium. During solidification of these commercial hypereutectic aluminum-silicon alloys, feeding does not become difficult until sometime after the coherency point is reached when the eutectic is mushy or partially solid. At this point, the primary silicon particles, the primary aluminum dendrites, and the partially solidified eutectic, as well as precipitated copper-containing phases form a solid maze. The remaining eutectic liquid must be pushed through this tortuous maze to feed the shrinkage porosity of the eutectic liquid.

It has been found that if the hypereutectic aluminum-silicon alloy contains a substantial copper content, copper-containing phases will be precipitated during the solidification process, and the copper-containing phases clog and seal the tortuous path for the passage of the interdendritic liquid. Thus, even the application of pressure to the copper-containing hypereutectic alloy will not feed the solidification shrinkage and the solidification shrinkage will create an interface for the nucleation of hydrogen porosity.

For example, starting with a porosity level of 2% for a control group for the hypereutectic aluminum-silicon alloy 390 containing 4.3% by weight of copper, the application of 10 atmospheres of pressure is only effective in reducing the porosity level to 0.3%, thus resulting in a reduction ratio, defined as the porosity level with no applied pressure divided by the porosity level with 10 atmospheres or pressure, of 7.

On the other hand, it has been unexpectedly discovered that by maintaining the copper content of a hypereutectic aluminum-silicon alloy at a low value, below about 0.8% by weight, the tortuous path through the maze of primary aluminum dendrites, primary silicon particles and mushy partially solidified eutectic will not be clogged and the application of pressure will feed the solidification shrinkage, thus preventing nucleation of hydrogen porosity. For example, starting with a control group for a hypereutectic aluminum-silicon alloy containing 0.45% by weight of copper at a porosity level of 2%, the resulting porosity level after the application of 10 atmospheres of pressure was 0.03%, thus resulting in a reduction ratio of 70. This is an order of magnitude better than the results for the copper containing hypereutectic aluminum-silicon alloy under identical conditions.

Thus, it has been unexpectedly discovered that by maintaining the copper content at a minimum value, the application of pressure during solidification of the alloy will produce a cast hypereutectic aluminum-silicon alloy having decreased porosity, below 0.03%, and having improved fatigue properties with a high cycle fatigue strength greater than 15 KSI.

DESCRIPTION OF THE PREFERRED EMBODIMENT

The invention is directed to a method of casting hypereutectic aluminum-silicon alloys in an evaporable or lost foam casting process to produce cast articles having reduced porosity and increased fatigue properties. The method of the invention has particular application in casting components for marine propulsion units, such as liner-less engine blocks and direct fuel injection heads.

The alloy to be used in the method of the invention is a hypereutectic aluminum-silicon alloy containing from 16% to 30% silicon and having less than 0.8% copper and preferably less than 0.6% copper. More particularly, the alloy can have the following composition in weight percent:

| | |
|---|---|
| Silicon | 17% to 25% |
| Magnesium | 0.3% to 1.5% |
| Iron | 0.05% to 0.6% |
| Manganese | 0.05% to 0.4% |
| Copper | Less than 0.8% |
| Aluminum | Balance |

A specific example of an alloy falling within the above range of composition is as follows in weight percent:

| | |
|---|---|
| Silicon | 19.5% |
| Magnesium | 1.1% |
| Iron | 0.1% |
| Manganese | 0.15% |
| Copper | 0.15% |
| Aluminum | 78.8% |

The evaporable foam pattern to be used in the casting process is formed from a polymeric material, such as polystyrene or polymethylmethacrylate, or a combination of the two, and has a configuration proportionally identical to the article to be cast. The foam pattern is normally coated with a porous ceramic material which tends to prevent metal-sand reaction and facilitates cleaning of the cast metal part. The ceramic wash coating can be applied by immersing the coating in the bath of the ceramic wash, draining the excess wash from the pattern and then drying the wash to provide the porous ceramic coating.

In carrying out the process of the invention, the coated pattern is supported in the mold and an unbonded, finely divided flowable material, such as silica sand, is introduced into the mold and surrounds the pattern, as well as filling the cavities in the pattern.

The molten alloy generally at a temperature of approximately 1600° F., is introduced through one or more sprues into the mold and into contact with the polymeric pattern. The heat of the molten metal will melt, vaporize and decompose in various fractions the polymeric sprue, as well as the pattern, with the resulting products of decomposition passing through the porous ceramic coating and into the interstices of the sand. The molten metal will occupy the void created by vaporization of the pattern to produce a cast metal article substantially identical in configuration to the pattern. The casting temperature of 1600° F. is about 200° F. above the liquidus temperature of the alloy to allow sufficient time for the products of the foam decomposition to escape through the wash coating. If the high casting temperature is not used the molten aluminum alloy metal can freeze before the liquid polymer has passed through the coating. When this occurs the heat given off by the solidified aluminum alloy is still sufficient to cause evaporation of the trapped liquid polymer. The end result is the solidified hypereutectic aluminum-silicon alloy casting now contains visible surface void shapes identical to the shapes of the previously trapped liquid polymer. The surface aesthetic of these defects can cause these castings to be rejected on appearance alone or as through thickness leakers. All other things being equal, the high casting temperature, that is needed to allow sufficient time for the products of the foam decomposition to escape, requires the casting process to deal with a higher shrinkage.

While the alloy is still in a molten state, pressure is applied to the alloy. Pressure can be applied to the alloy in the manner as set forth in U.S. Pat. No. 5,014,764 or U.S. Pat. No. 5,524,696. As disclosed in these patents, the mold is located within an outer vessel and after the molten alloy has been poured, the vessel is sealed and a gas pressure is applied to the interior of the vessel. The gas has a pressure of about 5 atmospheres to 12 atmospheres and preferably 8 atmospheres to 12 atmospheres. It is preferred that the pressure be applied as rapidly as possible, but in such a manner that metal penetration is avoided. It has been found that the use of a single screen coarse round sand of approximately 31 AFS Grain Fineness is better than a three screen silica sand of 40–50 AFS Grain Fineness in avoiding metal penetration.

Metal penetration is caused by the pressure difference between that which is applied to the metal and transmitted to the metal/sand interface and that which is applied to the sand and is transmitted through media and interstitial voids between the media to the sand/metal interface. When the pressure difference at the metal/sand interface is excessive, metal is forced to penetrate between the grains of sand and cause deformation of the surface of the cast article. To avoid metal penetration, the pressure is preferably increased progressively from zero to a maximum value over time.

It is recognized that there are two major fundamental effects that contribute to the formation of porosity in castings. These are (1) shrinkage resulting from the volume decrease in going from liquid to solid and (2) gas evolution resulting from the decrease in solubility in solid metal compared to the liquid. In connection with gas evolution, nucleation of a gas bubble is required before growth of gas generated porosity can occur. However, when shrinkage porosity forms, the large energy requirement for nucleation of a gas bubble is overcome. At this point, the porosity is assumed to grow to compensate for solidification shrinkage.

Hydrogen is the only gas with any significant solubility in molten aluminum. As a result, the rejection of hydrogen gas on solidification plays a major role in the development of porosity. The tendency for increased porosity levels due to the rejection of hydrogen gas during solidification is greatly facilitated by the shrinkage of the liquid metal in going to a solid, if unfed during solidification. The shrinkage for aluminum-silicon alloys in going from liquid to solid is quite substantial, approximately 6%. The rejection of hydrogen gas does not occur early in the solidification process, because the liquid is not saturated with hydrogen. Thus, hydrogen rejection occurs late in the solidification process in the interdendritic liquid.

In the solidification process, the spatial primary aluminum, primary silicon, and mushy partially solidified eutectic distribution can be considered as the depth "filter". This "filter" is created naturally by the primary aluminum dendrites and primary silicon particles that are precipitated and grow and impinge on their neighboring dendrites. The Christmas-tree like forms of the dendrites have a very low packing efficiency and in the solidification process of the eutectic a tortuous path is formed between the maze of primary aluminum dendrites, primary silicon particles, and mushy particle solidified eutectic. The remaining eutectic liquid must be continuously pushed through this "filter" to feed the shrinkage porosity of the eutectic liquid.

It has been discovered that with an aluminum-silicon alloy having a minimum copper content, i.e. below 0.8%, the interdendritic shrinkage of the alloy can be fed by applying pressure to the molten alloy. When pressure is applied to the alloy during solidification, solidification shrinkage is fed and hydrogen is prevented from nucleating because solidification shrinkage does not create an interface on which the hydrogen can precipitate and thus the hydrogen remains dissolved in solution.

It has been discovered that copper-containing aluminum-silicon alloys precipitate copper-containing phases in the trapped interdendritic liquid late in the solidification process and the copper-containing phases effectively clog and seal the tortuous path for the passage of interdendritic liquid. Thus, even the application of pressure cannot feed the solidification shrinkage. Because of this, the solidification shrinkage thus creates an interface for the nucleation of hydrogen porosity.

Therefore, it has been unexpectedly found that maintaining the copper content of the hypereutectic aluminum-silicon alloy at a minimum, or below 0.8%, will substantially and unexpectedly decrease porosity in the cast alloy and substantially improve the fatigue properties.

By keeping the interdendritic feeding channels open, through the appropriate choice of hypereutectic aluminum-silicon alloy chemistry, the use of low applied pressures (i.e. less than 12 atmospheres of pressure), inexpensive pressure systems can be used. This is much preferred over a process that uses high pressures (i.e. greater than 50 atmospheres of applied pressure) with expensive pressure systems, and crushes (i.e. hot forges) the dendritic network and attempts to collapse the feeding channels. Crushing an unsupported dendritic network with high pressure creates regions depleted in eutectic liquid and therefore a microsegregation. On the other hand, the use of lower pressure with the appropriate alloy keeps the feed channels full of eutectic liquid and avoids microsegregation.

A specific example showing the advantages achieved by the method of the invention is as follows:

A pair of castings were produced in an evaporable foam process using an aluminum-silicon alloy having the following composition in weight percent:

| | |
|---|---|
| Silicon | 19.8% |
| Magnesium | 0.8% |
| Manganese | 0.2% |
| Iron | 0.1% |
| Copper | 0.1% |
| Aluminum | 78.7% |

One of the articles was cast at atmospheric pressure and the other article was subjected to a pressure of 10 atmospheres during casting. The physical properties of the two cast articles were determined as follows:

| | No.1 Atmospheric Pressure | No.2 10 Atmospheres Pressure |
|---|---|---|
| Ultimate Tensile Strength | 29.1 KSI | 34.5 KSI |
| Yield Strength | 27.2 KSI | 29.6 KSI |
| High Cycle Fatigue Strength | 11.9 KSI | 15.1 KSI |
| Porosity | 1.8% | 0.009% |

The above data show the significant improvements in mechanical properties and porosity as achieved by the method of the invention. Most significantly, the fatigue strength was increased from 11.9 KSI to 15.1 KSI while the porosity was dramatically reduced from 1.8% to 0.009%. This level of porosity in bores of four stroke engines would meet the most stringent requirements for low oil consumption.

We claim:

1. A method of casting a hypereutectic aluminum-silicon alloy, comprising the steps of forming a pattern of an evaporable polymeric foam material having a configuration of an article to be cast, supporting the pattern in an outer mold, introducing unbonded sand into the mold to surround the pattern and fill cavities in the pattern, contacting the pattern with a molten hypereutectic aluminum-silicon alloy containing from 16% to 30% silicon and having less than 0.8% copper, said molten alloy acting to decompose the foam pattern with the products of decomposition being entrapped in the interstices of said sand, applying pressure in the range of 5 atmospheres to 12 atmospheres to the molten alloy, and solidifying the alloy to produce a solidified alloy having a microstructure comprising primary aluminum dendrites, primary silicon particles and eutectic and being substantially free of copper-containing phases, said solidified alloy having improved mechanical properties and a porosity of less than 0.3%.

2. The method of claim 1, wherein said aluminum-silicon alloy has the following composition in weight percent:

| | |
|---|---|
| Silicon | 16% to 30% |
| Magnesium | 0.3% to 1.5% |
| Iron | 0.05% to 0.6% |
| Manganese | 0.05% to 0.4% |
| Copper | Less than 0.8% |
| Aluminum | Balance. |

3. The method of claim 1, wherein the step of applying pressure to the molten alloy comprises the step of applying a gas under pressure to said alloy and gradually increasing the pressure of said gas.

4. The method of claim 1, and including the step of positioning the mold with the pattern and sand contained therein in an outer vessel and applying a gas under pressure to the interior of said vessel.

5. A method of casting a hypereutectic aluminum-silicon alloy, comprising the steps of forming a pattern of a polymeric foam material having a configuration of an article to be cast, supporting the pattern in an outer mold, introducing unbonded sand into the mold to surround the pattern and fill cavities in said pattern, contacting the pattern with a molten hypereutectic aluminum-silicon alloy having the following composition in weight percent:

| | |
|---|---|
| Silicon | 17% to 25% |
| Manganese | 0.3% to 1.5% |
| Magnesium | 0.05% to 0.6% |
| Iron | 0.05% to 0.6% |
| Copper | Less than 0.8% |
| Aluminum | Balance. |

said molten alloy acting to decompose said foam pattern with the products of decomposition being entrapped within the interstices of said sand, applying isostatic gas pressure in the range of 5 to 12 atmospheres to the molten alloy, while solidifying the alloy to produce a solidified alloy having a microstructure comprising primary aluminum dendrites, primary silicon particles and eutectic and being substantially free of copper-containing phases, said solidified alloy having a high cycle fatigue strength greater than 13 KSI and a porosity less than 0.03%.

* * * * *